United States Patent [19]

Jackson et al.

[11] Patent Number: 5,000,298

[45] Date of Patent: Mar. 19, 1991

[54] BRAKE BEAM

[75] Inventors: Robert G. Jackson; Leonard F. Manyek, both of Benton Harbor, Mich.

[73] Assignee: Triax Tube Co., Benton Harbor, Mich.

[21] Appl. No.: 408,628

[22] Filed: Sep. 18, 1989

[51] Int. Cl.[5] ..... B61H 13/34

[52] U.S. Cl. ..... 188/219.1; 188/52; 188/220.1; 188/232

[58] Field of Search ..... 188/52, 217, 219.1, 188/219.6, 220.6, 220.1, 229.6, 232, 234, 236, 242

[56] References Cited

U.S. PATENT DOCUMENTS

| | | | |
|---|---|---|---|
| 263,045 | 8/1882 | How | 188/217 |
| 889,138 | 5/1908 | Lamont | 188/220.6 |
| 1,179,879 | 4/1916 | Waugh | 188/52 X |
| 1,426,075 | 8/1922 | Hedglock | 188/229.6 |
| 2,159,100 | 5/1939 | Paterson | 188/229.6 |
| 3,621,941 | 11/1971 | Blout | 188/52 |

*Primary Examiner*—Duane A. Reger
*Attorney, Agent, or Firm*—Thomas J. Dodd

[57] ABSTRACT

A brake beam assembly for railroad cars. The brake beam includes a clevis rotatably connected to a channel member with the clevis having depending tabs which allow the clevis to be positioned in a right hand or left hand orientation. The clevis is connected to a leaf spring which is positioned in the channel member to accommodate excessive force during braking. The brake head is connected to an adaptor which allows the brake head and shoe to float and accommodate wheel wear or the misalignment of the brake beam and wheelset.

7 Claims, 3 Drawing Sheets

16
20
21
36
38
40
42
46
48
50

BRAKE BEAM

FIELD OF THE INVENTION

This invention relates to brakes and will have special application to brake beams for use with railroad cars.

BACKGROUND OF THE INVENTION

Brake beams used in conjunction with railroad cars have previously been constructed as a one-piece item with the brake heads and the connecting arm rigidly attached to the main beam. These beams were manufactured in both right hand and left hand orientations to accomodate both sets of wheels on the railroad car.

The beams are connected to actuating mechanisms which generally shift the beams between an unbraked position with the brake shoes (which are connected to the brake heads) spaced from the car wheels and a braked position in contact with the wheels to slow and/or stop the train.

These previous brake beams contained no structure which relieved excessive pulling force on the connecting arm, nor did they allow the brake shoes to adapt to the proper attitude on worn train wheels. As a result, prior beams were not totally effective in stopping the train, and were frequently broken which required expensive repair and/or rebuilding. Also, the rigid connection of the connecting arm to the main beam required that separate tooling be used to construct a right hand beam as opposed to a left hand beam.

SUMMARY OF THE INVENTION

The brake beam of this invention provides for a clevis type connection between the beam and the actuator. The clevis is rotatably connected to the beam and includes depending tabs which serve as stops to insure proper positioning of the clevis in either a right hand or left hand orientation. The clevis may also be connected to a biasing member which allows the clevis to be pulled outwardly of the beam with the biasing member, usually a leaf spring, absorbing any excessive pulling force.

Finally, the brake heads may be connected to adaptors by a ball and socket type joint which allows the brake head and shoe to adapt to the contour of the car wheels.

Accordingly, it is an object of this invention to provide for a novel and improved railroad car brake beam assembly.

Another object is to provide for a brake beam which accomodates excessive pulling force and resists breakage.

Another object is to provide for a brake beam which may be used in either a right hand or left hand configuration.

Another object is to provide for a brake beam which adjusts for wear of the train wheels to save wear and tear on brake shoes.

Other objects will become apparent upon a reading of the following description.

DESCRIPTION OF THE PREFERRED EMBODIMENT

Figure 1:
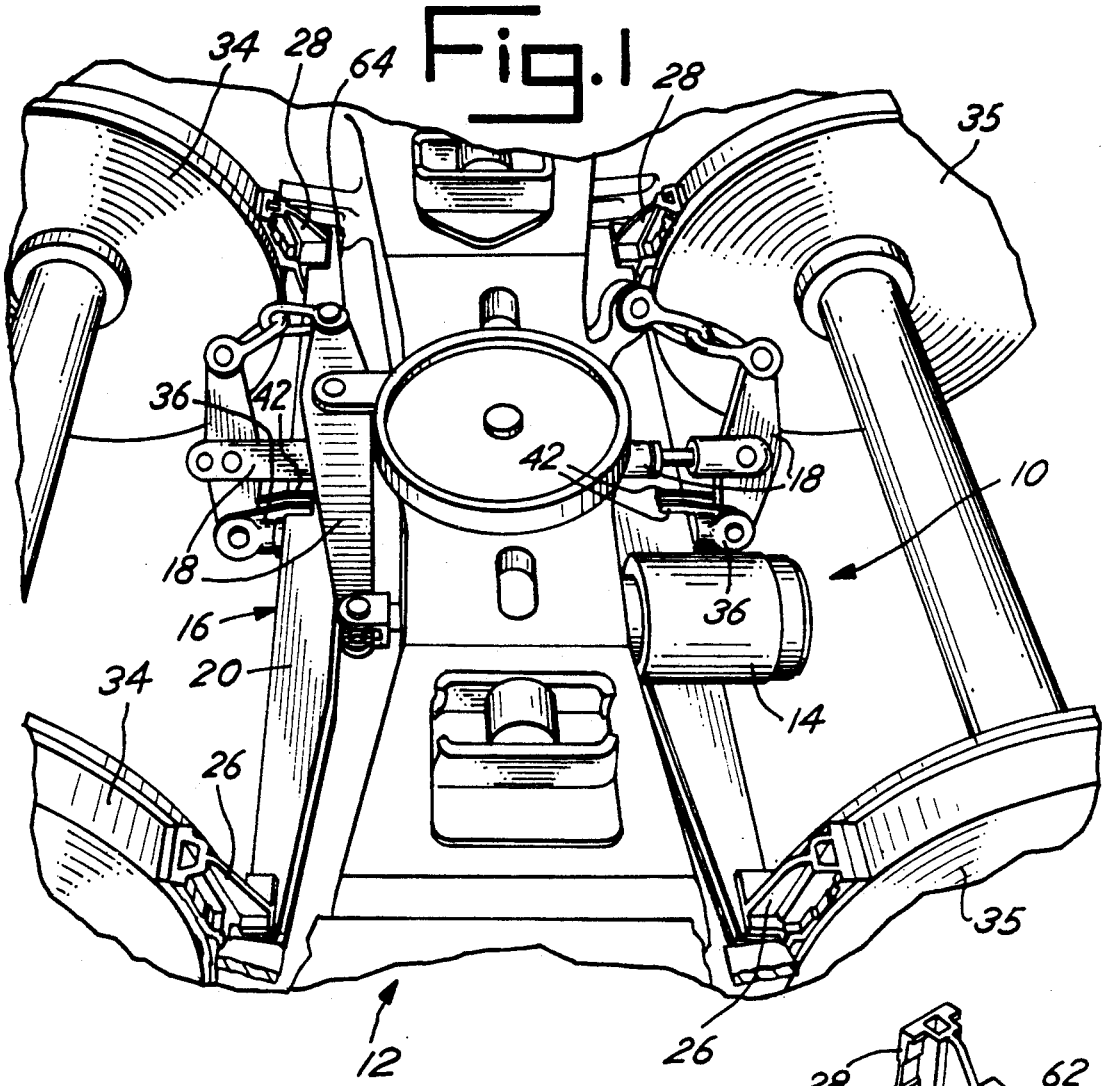
FIG. 1 is a fragmented perspective view of a railroad car chasis which utilizes the brake beam of this invention.

The preferred embodiment herein described is not intended to be exhaustive or to limit the invention to the precise form disclosed. It is chosen and described to explain the principles of the invention and its application and practical use to enable others skilled in the art to utilize the invention.

Referring to the drawings, reference numeral 10 refers generally to the brake assembly which is used to stop railroad car 12. Brake assembly 10 shown is commonly referred to as a hangerless brake with the power actuating cylinder 14 incorporated directly into the assembly. It is understood that brake assembly 10 will function as well in a conventionally hung brake assembly.

Assembly 10 includes brake beams 16 which are interconnected between power cylinder 14 through linkage assembly 18. Since both brake beams 16 are of substantially identical construction, the working componenets of one beam will be described with the understanding that both brake beams work in a like fashion. Further, linkage 18 does not form a novel part of this invention and is a common item in the railroad brake industry which allows both brake beams 16 to operate at the same time.

Brake beam 16 includes a channel member 20 which is substantially U-shaped and has opposite ends 22, 24. A brake head 26, 28 is secured in a common manner to channel member 20 adjacent an end 22, 24 respectively. Each brake head 26, 28 houses a brake shoe 30 (see FIG. 7) which engages the adjacent wheel 34 of railroad car 12 to slow and/or stop a train (not shown) when brake assembly 10 is shifted into the extended brake position of FIG. 7.

Figure 2:
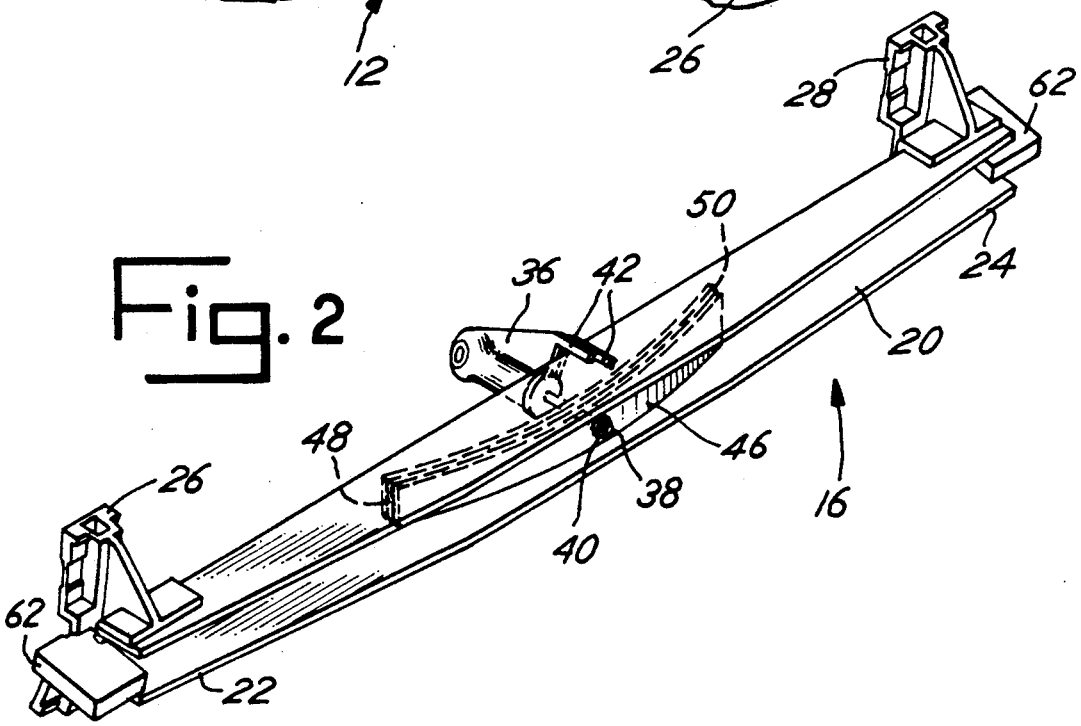
FIG. 2 is a perspective view of the brake beam of this invention.
Figures 3, 3A, 4:
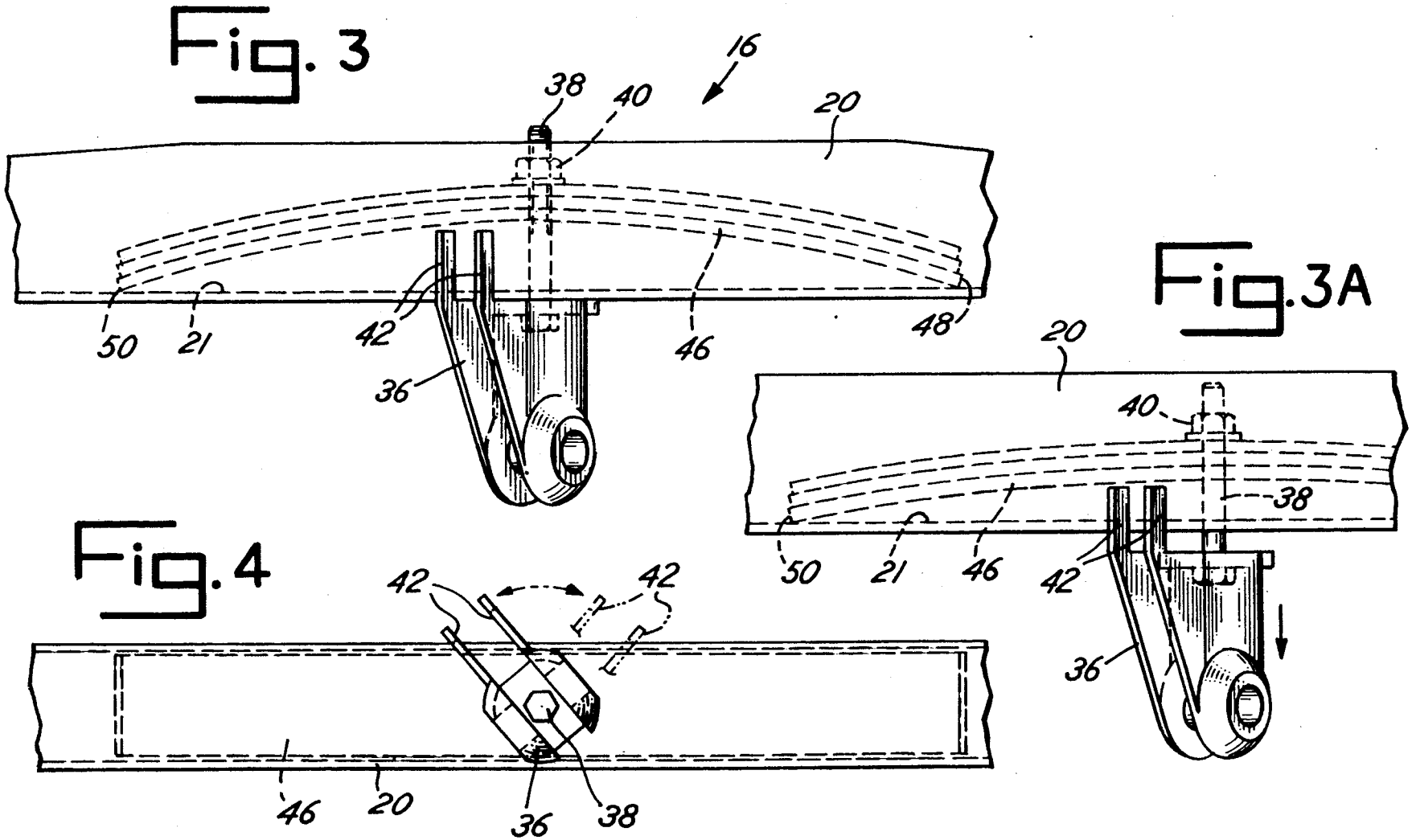
FIG. 3 is a fragamented elevation view of the brake beam.
FIG. 3A is a fragamented elevation view of the brake beam with the clevis in an extended position.
FIG. 4 is a fragamented plan view of the brake beam illustrating clevis rotation.
Figure 5:
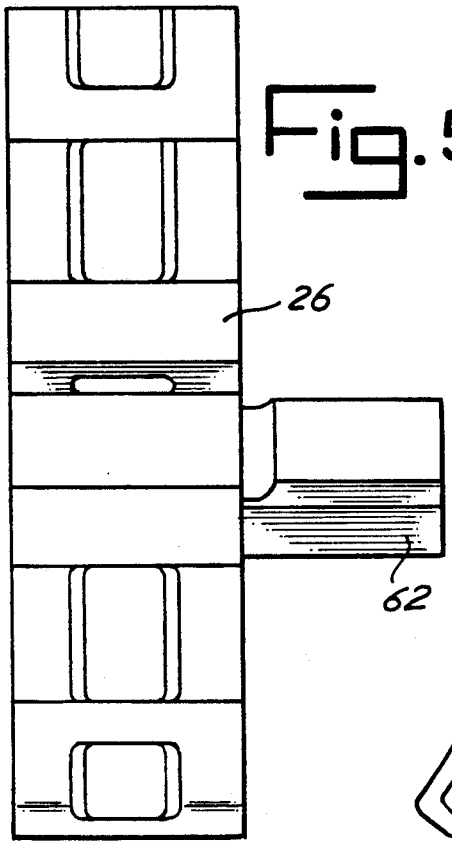
FIG. 5 is a plan view of the brake head.

Channel member 20 is operatively connected to linkage 18 through a clevis connector 36 as shown in FIG. 1. Clevis 36 is secured to channel member 20 by bolt 38 and nut 40 combination, which allows for rotation of the clevis between a right-hand orientation and a left-hand orientation (FIG. 4). The orientation will determine whether beam 16 is used on the front wheels 34 or rear wheels 35 of car 12. Clevis 36 includes depending projections 42 which serves as stop members to accurately position the clevis in its desired orientation and to prevent over-rotation. Bolt 38 may extend through a biasing member, illustrated as leaf sping 46 in FIGS. 2-3. Leaf spring 46 has its opposite ends 48, 50 in abutment against surface 21 of channel member 20.

Figure 6:
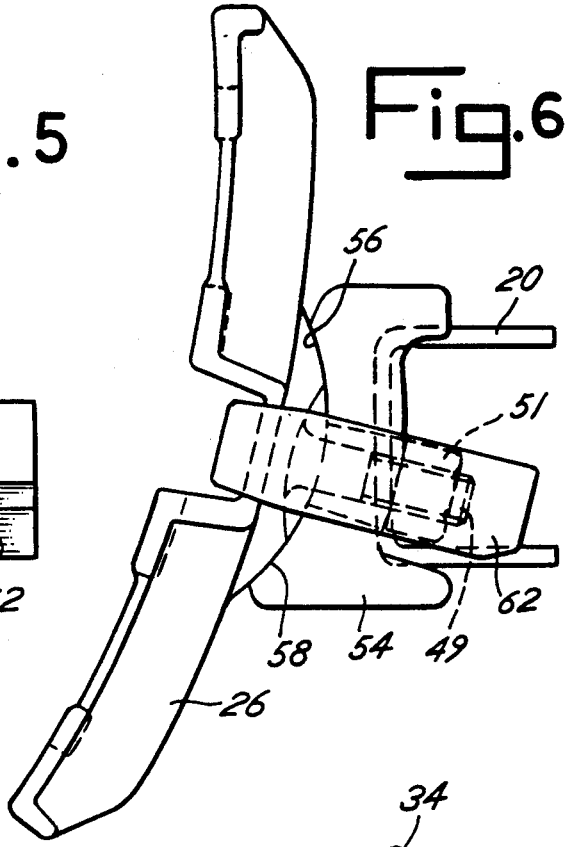
FIG. 6 is an elevation view of the brake head assembly of this invention.
Figure 7:
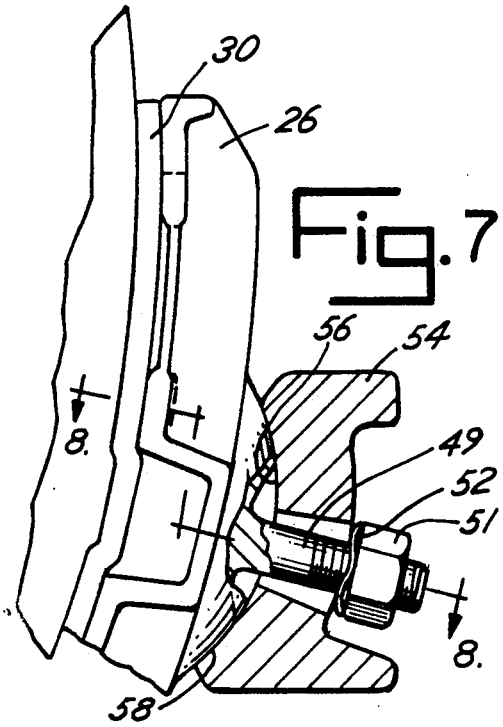
FIG. 7 is a fragamented detail view of the brake head and shoe in a braked position.
Figure 8:
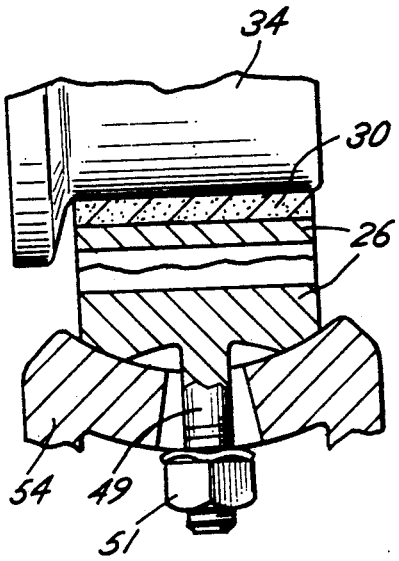
FIG. 8 is a cross-sectional view taken along line 8—8 of FIG. 7.

FIGS. 6-8 illustrate an alternative configuration of brake head 26. Since both brake heads 26, 28 are identical, only brake head 26 will be shown and described in detail.

Brake head 26 includes an integral threaded stud 49 which extends through channel member 20 and with nut 51 and spring 52 secures the brake head to the channel member as shown in FIG. 6. A rotation adaptor 54 is positioned between brake head 26 and channel member 20 and has a radiused surface 56 which is complemental with radiused surface 58 of the brake head as shown. Stud 48 also extends through adaptor 54 to operatively couple the adaptor and brake head 26. Brake head 26 includes a common brake shoe 60, which is secured to brake head 26 in a common manner. Brake head 26 also includes an alignment paddle 62 which rides in a slot 64 formed in railroad car 12. It is understood that the radiused connection between brake head 26 and adaptor 54 may be of a ball and socket variety, or may take the general configuration shown, so long as brake head 26 is able to rotate independently of channel member 20.

Brake beam 16 operates to slow and/or stop car 12 in the following fashion. Again, since both beams 16 are of substantially identical function with each beam acting to apply friction to its adjacent set of wheels, only the operation of one such beam will be discussed.

When braking force is required, cylinder 14 is actuated to extend the beam 16 into its braked position, as seen in FIG. 7. Linkage 18 pulls on clevis 36 to urge the beam toward the wheels 34 with brake shoe 30 contacting the wheels to create friction and slow and/or stop car 12. As the pulling force through the clevis 36 increases the beam acts as a rigid member until the force reaches the predetermined preload of leaf spring 46. If the applied force exceeds the preload, clevis is pulled outwardly of channel member 20 and its movement biased by leaf spring 46 (see FIG. 3A). Normal braking loads will not exceed the leaf spring preload.

Brake heads 26 accomodate wear on car wheels 34 through radiused mating surfaces 56, 58. As wheels 34 wear and change configuration, brake head 26 is properly aligned to provide maximum contact area between the wheel and brake shoe 30 as shown in FIGS. 7 and 8.

It is understoood that the above description does not limit the invention to the details given, but may be modified within the scope of the following claims.

We claim:

1. A brake beam assembly adapted for use with railroad cars, said brake beam assembly comprising an elongated beam, a brake head means for accomodating a brake shoe connected to said beam adjacent to opposite ends of the beams, said brake head means including a brake head and an adaptor connected to the brake head at a joint, said adaptor having a smooth rounded surface mating with a smooth rounded surface of said brake head, connector means connected to said beam at approximately a midpoint of the beam, said connector means for coupling said brake beam assembly to a brake actuator, said connector means including a clevis rotatably connected to said beam between a right hand orientation and a left hand orientation, said clevis including a depending tab, said tab constituting stop means contacting said beam for positioning said clevis in one of said right hand or left hand orientation.

2. The brake beam assembly of claim 1 wherein said beam is a generally U-shaped channel member.

3. the brake beam assembly of claim 2 wherein said clevis is connected to said beam by a fastener extending through said clevis and beam, said fastner also extending through and secured to a biasing member housed in said beam, said biasing member constituting means for absorbing excessive pulling force on said clevis by said brake actuator.

4. the brake beam assembly of claim 3 wherein said biasing member is a leaf spring.

5. The brake beam assembly of claim 1 wherein said brake head means includes a brake head and an adaptor, said brake head and adaptor connected by a ball-and-socket joint wherein said brake head plate adapts to contours caused by wear of railroad car wheels.

6. A brake beam assembly adapted for use with railroad cars, said brake beam assembly comprising an elongated beam, means for coupling said beam to a brake actuator, said brake actuator constituting means for shifting said brake beam assembly between a non-braking position and a braked position, brake heads connected to said beam at opposite ends thereof, each brake head accomodating a brake shoe, said brake shoe contacting wheels of a railroad car when the brake beam assembly is in the braked position to stop the car, each brake head including an adaptor connected said beam and said brake head, said adaptor and brake head connected by a ball-and-socket joint whereby the brake head and brake show adapt to contours caused by wearing of said railroad car wheels.

7. The brake assembly of claim 1 wherein said brake beam assembly includes a biasing means, said biasing means includes a leaf spring, a fastener extending through said connector means and through said beam and leaf spring to operatively connect the same.

* * * * *